US006494008B1

(12) United States Patent
Bloem et al.

(10) Patent No.: US 6,494,008 B1
(45) Date of Patent: Dec. 17, 2002

(54) DUAL SECTION SOUND WALL PANEL AND METHOD OF MANUFACTURE

(75) Inventors: Alec C. Bloem, San Diego, CA (US); William J. Neely, San Diego, CA (US)

(73) Assignee: L. B. Foster Company, Pittsburgh, PA (US)

( * ) Notice: Subject to any disclaimer, the term of this patent is extended or adjusted under 35 U.S.C. 154(b) by 0 days.

(21) Appl. No.: 09/925,083

(22) Filed: Aug. 8, 2001

(51) Int. Cl.[7] ..... E04H 17/00

(52) U.S. Cl. ..... 52/405.1; 52/612; 52/282; 52/601; 52/375; 181/210

(58) Field of Search ..... 52/405.1, 375, 52/601, 612

(56) References Cited

U.S. PATENT DOCUMENTS 1,031,926 A * 7/1912 Hansbrough ..... 52/213
2,111,577 A * 3/1938 Thomas ..... 249/13
2,321,813 A * 6/1943 Henzel ..... 110/336
3,555,763 A * 1/1971 Bloxom ..... 264/338
3,872,636 A * 3/1975 Nicosia ..... 52/241
4,320,606 A * 3/1982 GangaRao ..... 52/125.5
4,605,090 A * 8/1986 Melfi ..... 181/210
5,129,203 A * 7/1992 Romero ..... 52/309.11
5,138,813 A * 8/1992 Cooney et al. ..... 52/600
5,361,556 A * 11/1994 Menchetti ..... 52/271

* cited by examiner

*Primary Examiner*—Carl D. Friedman
*Assistant Examiner*—Basil Katcheves
(74) *Attorney, Agent, or Firm*—Brown Martin Haller & McClain LLP

(57) ABSTRACT

A dual membered sound wall panel constructed of two pre-formed half-panels. The half-panels have an inner surface that contains a plurality of connectors around their periphery and an outer surface. The outer surface may be textured if desired. The half-panels are each of concrete material with an embedded layer of mesh re-bar. The half-panels are oriented so that their inner surfaces are facing each other and the embedded connectors on each face are secured to each other. Additionally, between the half-panels are contained multiple spacer plates.

31 Claims, 3 Drawing Sheets

DUAL SECTION SOUND WALL PANEL AND METHOD OF MANUFACTURE

BACKGROUND OF THE INVENTION

This invention relates to an improved sound wall of the type used along roads and freeways to block traffic noise from adjacent landowners as well as block the view of the road or freeway.

Sound walls have become a popular way to reduce noise pollution from freeways and highways into adjacent residential and commercial neighborhoods located on the other side of the walls. These walls have been constructed with the desired goal of reducing noise from passing traffic into neighborhoods. Additionally, such walls not only provide noise reduction, but added security features. Because the dimensions of the walls are generally fairly high and quite long, people and objects from the freeway or highway do not enter the residential neighborhoods. Therefore, there is no disturbance to either the residents or alternatively to their houses or property. Additionally, they also serve as a safety device to stop pedestrian traffic across major roads or freeways.

Known sound walls are typically thin (about 6" thick) and often have an attractive pattern or profile molded into the traffic side or sometimes both sides. Many prior art walls have been built up of bricks, concrete blocks, or other types of masonry. Recent environmental concerns have even led to the creation of sound walls which include various types of living plants so that both the sound is absorbed and, additionally, the walls trap many airborne particles and create a natural carbon monoxide uptake. Construction of these walls has generally been labor intensive and expensive and additionally such walls become unstable with increasing height.

Sound walls are normally subject to elements such as wind loads and earthquake shaking depending on where they are located. For example, in eastern Colorado, the wind loads can be quite severe in the open country. Alternatively, in seismically active areas such as California, these walls can be subject to severe earthquake activity.

Past practice in constructing sound walls has typically been to cast concrete walls within a two-sided form. Vertical molds with an approximately 6" interior width are formed. These forms contain liners on their inner or facing sides. A re-bar lattice or steel mesh is placed inside the mold and then concrete is pumped or poured into the mold. This practice often leads to problems in forming the sound wall panels because the concrete does not flow well through the narrow forms, and this often results in non-uniformity of the finished texture or pattern. This practice leads to products that are not uniform throughout and therefore weaker in certain spots than others. This is particularly true towards the bottom of the mold, resulting in honeycombed areas.

In order to overcome the above problems, previous sound walls have often been poured only to a shallow depth, using short forms. These forms have been on the order of only 2' to 3' tall and are then constructed in layers to achieve greater height. This solution leaves the concrete more uniform in nature, but presents another problem in that it results in a finished wall with a series of unattractive horizontal joint lines every 2' to 3' up the entire length of the wall.

Therefore, there is a need for a sound wall system that provides noise reduction, is easy to form and install, and maintains consistent structure and aesthetics throughout.

SUMMARY OF THE INVENTION

It is an object of the present invention to provide a new and improved sound wall construction and method for making the same.

According to one aspect of the present invention, a dual membered sound wall panel is provided. First and second corresponding half-panels are formed. These half-panels have inner surfaces and outer surfaces that may be textured in order to be aesthetically appealing. The textured outer surfaces may be of the same pattern or alternatively they may be different from one another. If no textured pattern is desired there does not have to be any texture on the surface. The outer textured surface can be made of one of many different forms depending on the look desired. The half-forms also have opposing first and second ends and additionally opposite sides. Contained on the inner surfaces of the half-planes are connectors. These connectors are embedded into and around the periphery of the half-panels. The first and second half-panels are oriented with their inner faces oriented towards each other on parallel planes. This configuration positions the connectors of both half-plates facing each other. The outer surfaces of both the half-plates are positioned away from each other so that they are exposed externally while the faces with the connectors are contained internally and are not exposed. Several spacer plates are contained between the first and second half-plates. These spacers allow a gap to be defined between the two half-panels. The connectors of the half-plates may be made of steel angle irons and therefore allow for connection of the two half-plates to be made by welding the angle irons of each half-plate to each other. Alternatively, one skilled in the field will realize that the two half-plates may be connected to each other by any other suitable means. Such means include but are not limited to bolted connections, pin-and slot connectors, or any welded connectors. Additionally, if it is so desired, the gap created between the two half-plates may be filled with sound absorbing material in order to further reduce any noise pollution.

Once the dual membered panels are completed, a plurality of panels are positioned in an orientation that completes a wall structure. The dimensions of such a constructed wall are limited only in the ability of the panels to be self supporting when they are oriented into position. The placement of such completed sound walls would be like any other sound walls currently available and be used for purposes such as structural support, maintaining backfill, or merely diminishing sound pollution.

An advantage of the present invention is that because the two half-panel sections can be oriented with the gap between them, should one plate require removal, this may be done without disturbing the other plate. If only one side of the sound wall is damaged, that portion may be removed by burning off the connectors from one side and removing them while the other side remains in place. This provides a great advantage in that the damaged half-panel can be replaced and re-connected into position without losing the value or function of the sound wall in the interim. Also, because only part of the section of the wall needs to be replaced, this cuts down on costs associated with maintaining the sound wall. Even considering the fact that the present sound wall construction requires a modestly greater thickness (typically 7½" as opposed to 6"), the present embodiment is still competitive in terms of price relative to the prior sound walls. The added thickness does not significantly alter the total cost of completion and installation because the casting is easier and less expensive than trying to pour a thin wall between forms as in the previous sound wall constructions.

Another advantage is that in certain highway applications where sound wall panels are required to have a formliner or architectural finish on one or both sides, the present invention removes the previous problem associated with sound walls. The present invention does not result in a poor quality finish or unacceptable differences in the quality of the finish that can occur on the opposite faces of a single panel.

Additionally, because the construction of the sound wall system is more efficient than in the past, there is an increase in the number of applications. For example, the system may be used as sound absorbent fencing for residential properties. Within neighborhoods often there is a need for noise reduction for things other than traffic or freeway noise. The sound wall system may provide both privacy and efficient noise reduction for people who desire such for their houses. Also, commercial buildings around industrial or power plants may find value in utilizing the sound wall construction because it is an economical way to allow operations to continue with minimal interference to surrounding elements. Not only does the sound wall system reduce noise, but the aesthetic appearance of the system can disguise the industrial setting to any surrounding area.

According to another embodiment of the present invention, a method of making a dual membered sound wall construction from two pre-formed half-panels is provided, which comprises the steps of placing a mold box horizontally on a work table that is the same size as the desired face of the half-panels. The mold box has a closed base, upstanding side and end walls, and an open top part. If it is desired that the outer surface of the half-panel be textured, a textured form liner is placed into the mold box. Then a layer of re-bar is installed into the mold box that extends across the entire length and width of the mold box. If a textured liner is placed into the mold box, then the re-bar mesh is spaced between the top of the liner, and the top of the box. However, if no liner is desired, the re-bar mesh is spaced between the top and bottom of the box. Alternatively, the textured surface may be created by use of a stamp apparatus that presses a profile into the back side of the panel on the table. Then numerous embedment angle irons are placed at spaced intervals around the periphery of the open top of the box. Each of the angle irons has a first leg extending downwardly adjacent a respective wall of the box and a second leg projecting inwardly and coplanar with the open top of the box. After that, enough concrete is poured to fill the mold box. Once the concrete has been poured, the concrete panel is allowed to set so that the re-bar is embedded within and the angle irons are positioned around the periphery of the inner face of the half-panel. The concrete panel may be allowed to set while in the horizontal position, or alternatively, the table on which the mold box is positioned may tilt up and allow the mold to be removed while still in the semi-set form. The panel may then be allowed to set at another location. The above described steps are then repeated in order to form a corresponding second half-panel. The two formed half-panels are then positioned face to face so that the inner faces of each half-panel are facing inwards. This orientation means that the outer surfaces are exposed while the inner surfaces are not exposed but are contained entirely within the internal structure of the dual membered panel. The two half-panels are then secured either by welding together the facing fillet angle irons or alternatively bolting, tying, or bonding the angle irons in any other appropriate manner.

The construction of the sound wall with the use of two separate pre-formed members allows each section of the sound wall to be constructed solidly and in a more uniform manner than previously available. The construction of the present sound wall does not suffer from honeycombing and does not result in poor facing profile reproduction. Finally, the present invention does not cause horizontal or vertical lines in the final construction as did the prior art walls.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION AND PREFERRED EMBODIMENTS

Figure 1:
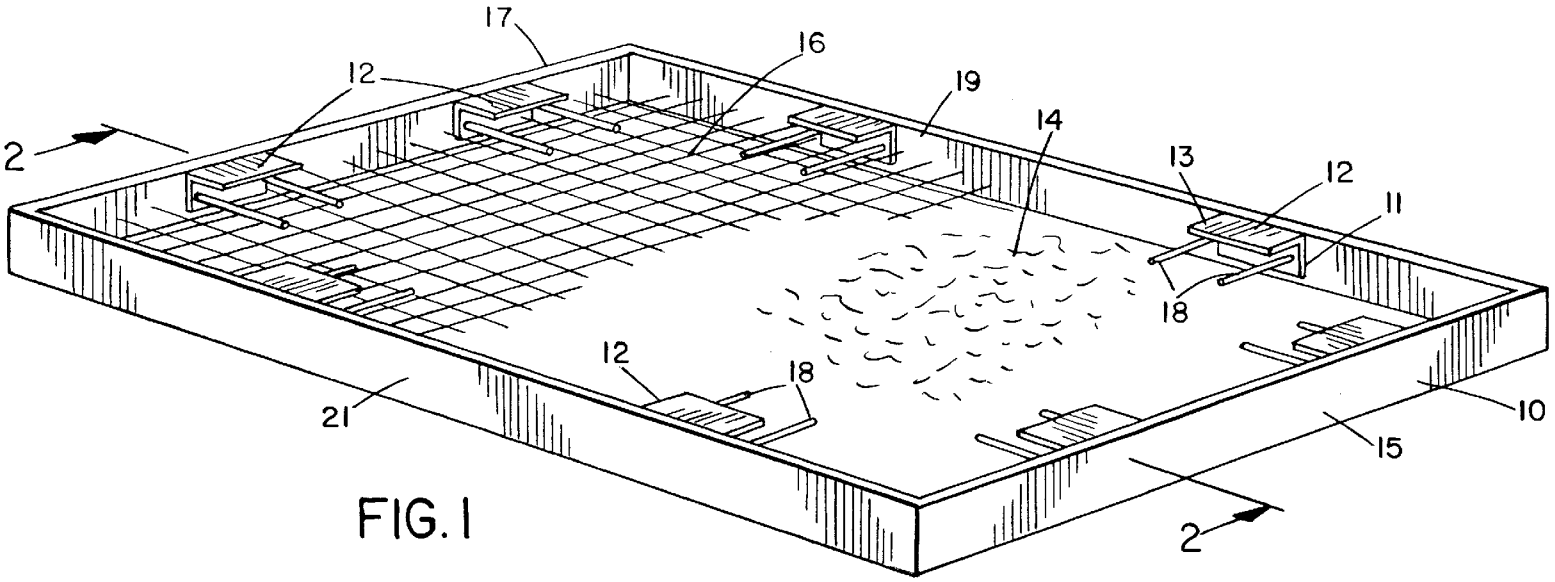
FIG. 1 is a perspective view of a mold box with the reinforcing structure in place ready for pouring the cement.

FIG. 1 is a perspective view of a mold box 10 with the reinforcing structure in place ready for pouring the cement. The mold box 10 is defined by opposite first and second ends 15, 17 and opposing sides 19, 21. The bottom flat surface of the mold 10 may contain a textured surface liner 14 that is any one of many desired textured designs. The textured surface liner 14 is placed between the bottom and the top of the mold 10 and it forms the outside textured surface 14 of the half-panels (See FIG. 6). If a textured outer surface is not desired, the textured liner 14 does not have to be placed in the mold box 10. Re-bar mesh 16 is also placed within the mold box 10. If a textured surface liner 14 is contained within the mold box 10, then the re-bar 16 is placed above the liner 14. Alternatively, the re-bar is spaced between the top and bottom of the mold box 10. The textured surface may be contained on one or both sides as desired (See FIG. 6). If no texture is required, it may not appear on any side (See FIG. 4). Additionally, each textured side 14 (See FIG. 6) may have the same or different textured pattern depending what type of appearance is wanted. Re-bar mesh 16 is also placed within the mold box 10. If a textured surface liner 14 is contained within the mold box 10, then the re-bar 16 is placed above the liner 14. Alternatively, the re-bar is spaced between the top and the bottom of the mold box 10. Numerous angle irons 12 are contained within the mold box 10 around the periphery. These angle irons 12 have a first leg extending downwardly 11 adjacent a respective wall of the mold box 10 and a second leg projecting inwardly 13 and co-planar with the top of the box. Re-bar prongs 18 are connected to the first leg 11 of the angle iron and extend parallel to the top of the box and are secured to the re-bar mesh 16. When forming the half-plates, concrete is poured into the mold box 10 and then is allowed to set.

Figure 2:
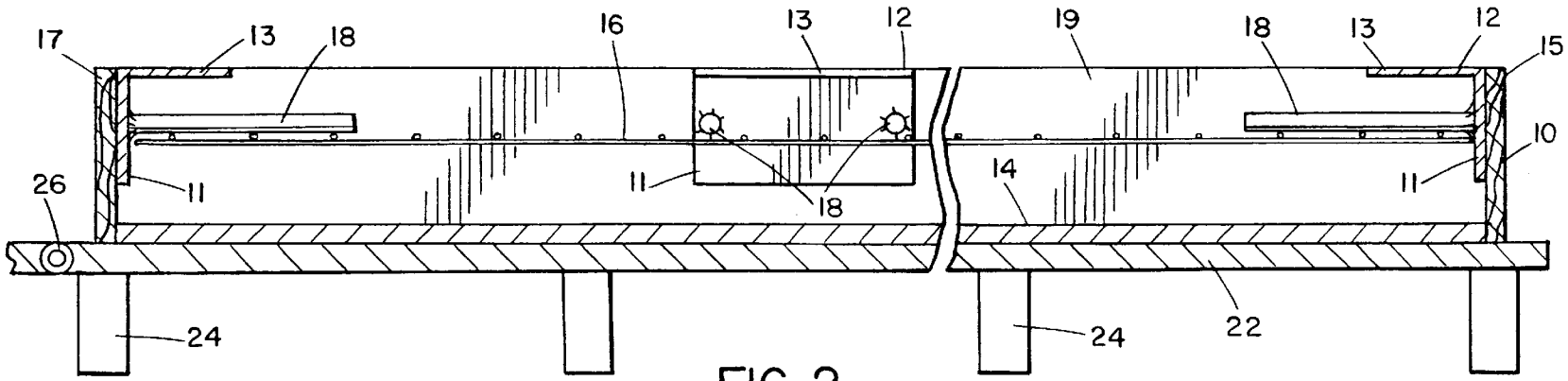
FIG. 2 is an enlarged sectional view taken on line 2—2 of FIG. 1.

FIG. 2 illustrates the mold box 10 as placed on a work table 22 which is supported by any suitable supports 24. The work table 22 is approximately the same dimensions in length and width as the mold box 10 and has a hinge 26 at one end that pivots the work table 22. The work table 22 may be elevated in order to allow the formed half-plate to be easily lifted from the work table 22. Alternatively, the formed panels may be removed from the table top by other mechanical devices or human labor that does not involve the pivoting table (Not Shown).

Figure 3:
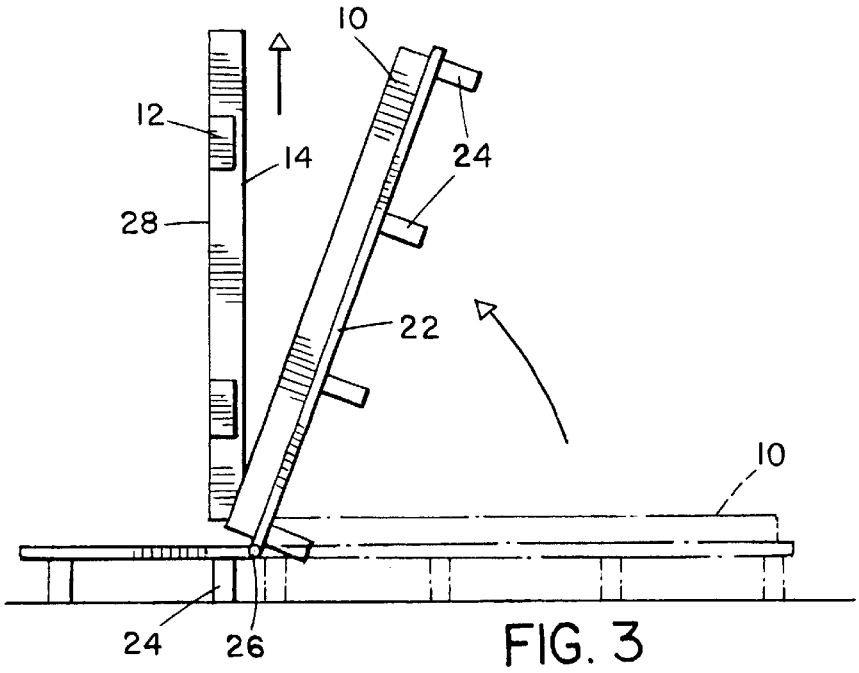
FIG. 3 illustrates the mold box being raised to remove the cast panel.

FIG. 3 illustrates the work table 22 being raised to remove the cast half-panel 28. The work table 22 has suitable supports 24 that come in contact with the floor. One end of the work table has a hinge 26 that allows the work table to be elevated at an angle with respect to the floor to allow for the formed half-panel 28 to be removed from the table 22 after it has been poured and set. The formed half-panel 28 is poured so that if a textured side 14 is desired, it is formed from the bottom of the mold box 10. Also, the embedded angle irons 12 are contained around the periphery of the half-panel 28.

Figure 4:
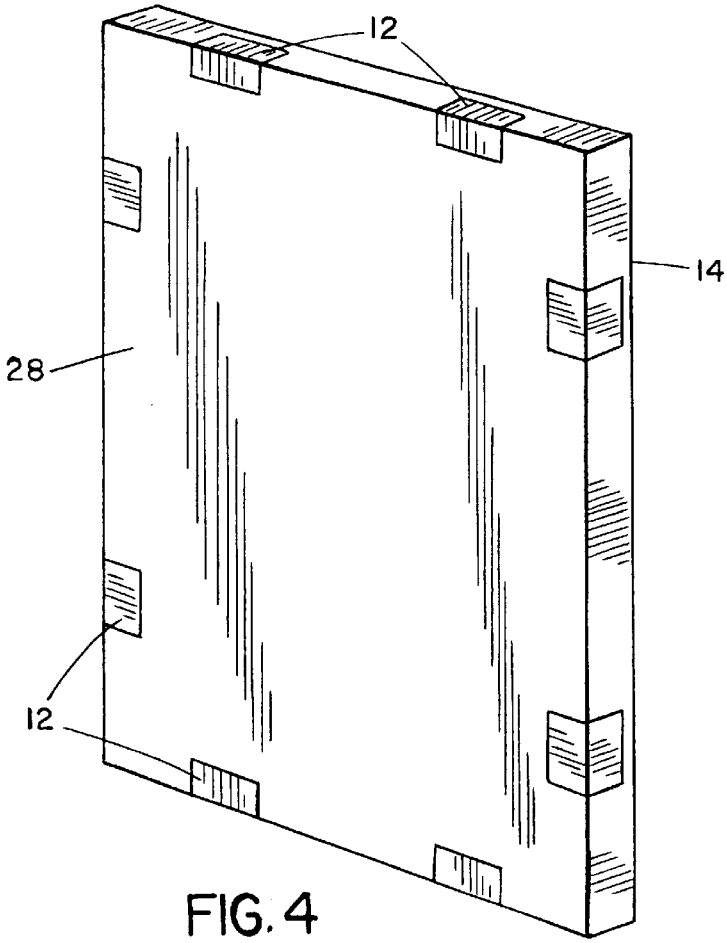
FIG. 4 is a perspective view of the cast panel.

FIG. 4 is a perspective view of the cast panel 28. All cast panels have embedded angle irons 12 contained thereon and exposed on the inner face and side edges of the panel, as illustrated. Some formed half-panels 28 contain a textured outer surface 14.

Figure 5:
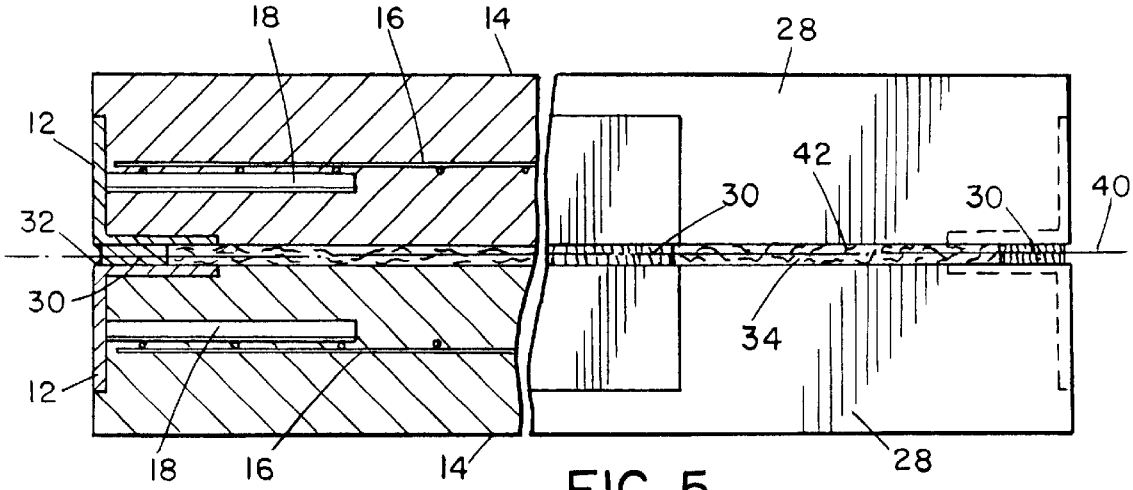
FIG. 5 is a side view, partially cut away, of the two panels joined with their inner faces positioned so that they are facing each other.

FIG. 5 is a side view, partially cut away, of the two panels joined with their inner faces positioned so that they are facing each other. Multiple spacer plates 30 are positioned between opposing angle irons 12 on the two facing half-panels. In certain embodiments, a gap 34 is created between the positioned spacer plates 30 and the inner faces of the half-panels. Also, in certain embodiments that contain textured surfaces 14, these surfaces face outward on the joined half-panels. The textured surfaces may be contained on any of the outer sides or on neither of the outer sides depending on the desired effect. The two half-panels are joined by connecting the embedded angles 12 of the half-panels. This can be done by a fillet weld 32 that joins the embedded angle irons 12 of both facing half-panels together. If any one of the half-panels requires repair, it may be removed by burning off the welds as illustrated by cut line 40 showing where the panel would be removed from the other to make the necessary repairs. Additionally, if additional sound proofing is required, the gap formed by the half-panels may be filled with any type of desired sound proofing material 42.

Figure 6:
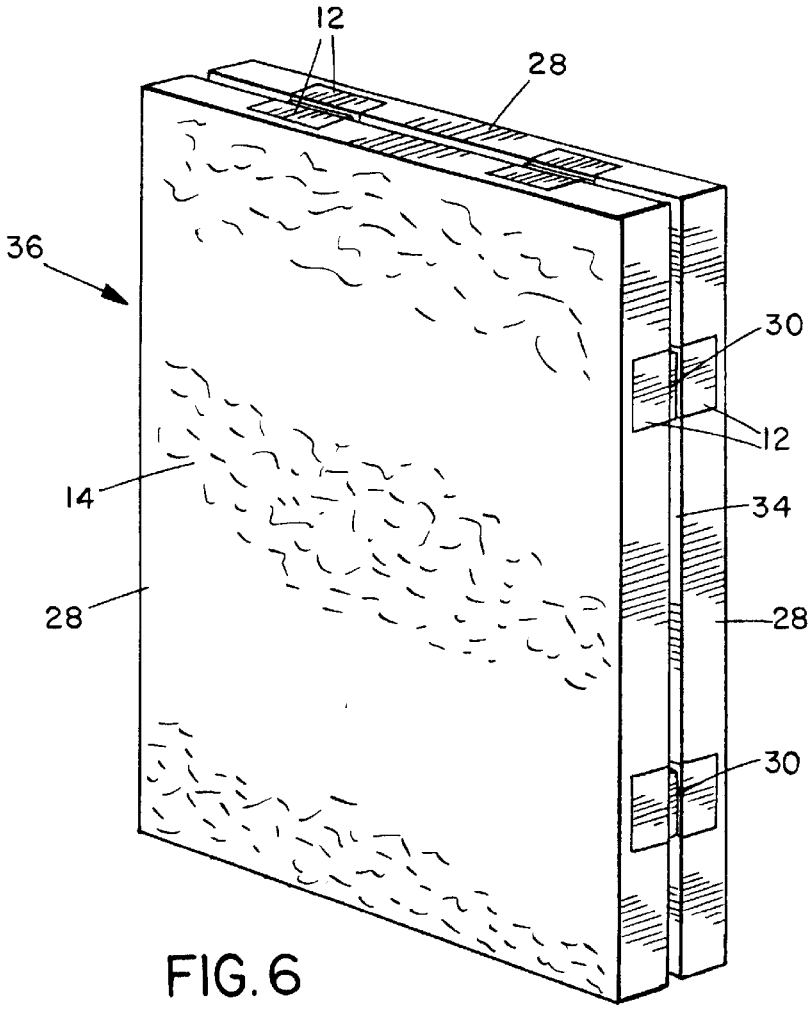
FIG. 6 is a perspective view of the finished double panel.

FIG. 6 is a perspective view of the finished double panel 36. When a textured surface 14 is present, it is contained on the outside of the double panel 36. The embedded angle irons 12 are contained around the periphery of the half-panels and connected together in order to form the completed double panel 36.

Although an exemplary embodiment of the invention has been described above by way of example only, it will be understood by those skilled in the field that modifications may be made to the disclosed embodiment without departing from the scope of the invention, which is defined by the appended claims.

We claim:

1. A dual membered sound wall apparatus comprising:

a first pre-formed half-panel having an inner surface, an outer surface, opposite first and second ends, and opposite sides, wherein the inner surface contains a plurality of connectors spaced around the periphery of the half-panel;

a second pre-formed half-panel having an inner surface, an outer surface, opposite first and second ends, and opposite sides, wherein the inner surface contains a plurality of connectors spaced around the periphery of the half-panel, said second half-panel positioned parallel to the first half-panel with the inner face of the second panel facing the inner face of the first panel and the sides and ends of the first panel aligned with the corresponding sides and ends of the second panel, and the connectors of the first half-panel aligned with the connectors of the second half-panel;

a plurality of spacer plates positioned between the first and second half-panels wherein at least one spacer plate is aligned between corresponding connectors of the first and second half-panels; and a securing device with means for connecting the connectors of the first and second half-panels to the spacer plates;

wherein the first and second half-panels are each of concrete material with an embedded layer of mesh re-bar extending substantially throughout the entire area of the half-panels.

2. The apparatus as claimed in claim 1, wherein the first and second half-panels are each on the order of 3½" thick.

3. The apparatus as claimed in claim 1, wherein the spacer plates define a gap between the inner faces of the two half-panels that is about ½" thick.

4. The apparatus as claimed in claim 1, wherein the completed construction is between 6½" to 7½" thick.

5. The apparatus as claimed in claim 4, wherein the half-panels are solid and of uniform thickness over their entire body.

6. The apparatus as claimed in claim 3, wherein the gap is filled with sound absorbing material.

7. The apparatus as claimed in claim 5, wherein the outer surface of the first pre-formed half-panel has a textured surface.

8. The apparatus as claimed in claim 7, wherein the outer surface of the second pre-formed half-panel has a textured surface.

9. The apparatus as claimed in claim 8, wherein the texture on the outer surface of the first pre-formed half-panel is the same as the texture of the second pre-formed half-panel.

10. The apparatus as claimed in claim 8, wherein the texture on the outer surface of the first pre-formed half-panel is different than the texture of the second pre-formed half-panel.

11. The apparatus as claimed in claim 1, wherein the connectors on the inner surfaces of the first and second half-panels are embedded angle irons.

12. A dual membered sound wall apparatus comprising:

a first pre-formed half-panel having an inner surface, an outer surface, opposite first and second ends, and opposite sides, wherein the inner surface contains a plurality of separate embedded angle irons spaced around the periphery of the half-panel;

a second pre-formed half-panel having an inner surface, an outer surface, opposite first and second ends, and opposite sides, wherein the inner surface contains a plurality of separate embedded angle irons spaced around the periphery of the half-panel, said second half-panel positioned parallel to the first half-panel with said inner face of said second panel facing said inner face of said first half-panel, and the angle irons of one panel aligned with the angle irons on the other half-panel;

a plurality of spacer plates positioned between the first and second half-panels to form a gap of predetermined thickness between the inner faces of the half-panels;

a plurality of fillet welds connecting at least some of the aligned pairs of embedded angle irons from the first and second half-panels; and the first and second half-panels are each of concrete material with an embedded layer of mesh re-bar extending substantially throughout the entire area of the half-panels.

13. The apparatus as claimed in claim 12, wherein the first and second half-panels are each on the order of 3½" thick.

14. The apparatus as claimed in claim 12, wherein the spacer plates define a gap between the two half-panels that is about ½" thick.

15. The apparatus as claimed in claim 12, wherein the completed construction is between 6½" to 7½" thick.

16. The apparatus as claimed in claim 12, wherein the half-panels are solid and of uniform thickness over their entire body.

17. The apparatus as claimed in claim 12, wherein the embedded angle irons have a first leg extending downwardly along a respective side of the half-panel and a second leg projecting inwardly and co-planar with the inner surface of the half-panel.

18. The apparatus as claimed in claim 17, wherein the embedded angle irons have a re-bar prong connected to the second leg and projecting inwardly and secured to the mesh re-bar.

19. The apparatus as claimed in claim 12, wherein the fillet welds integrally connect the angle irons located on the first half-plate to the angles located on the second half-plate and to the spacer plate located centrally between the two half-plates.

20. The apparatus as claimed in claim 12, wherein the gap is filled with sound absorbing material.

21. The apparatus as claimed in claim 12, wherein the outer surface of the first pre-formed half-panel has a textured surface.

22. The apparatus as claimed in 21, wherein the outer surface of the second pre-formed half-panel has a textured surface.

23. The apparatus as claimed in claim 22, wherein the texture on the outer surface of the first pre-formed half-panel is the same as the texture of the second pre-formed half-panel.

24. The apparatus as claimed in claim 22, wherein the texture on the outer surface of the first pre-formed half-panel is different than the texture of the second pre-formed half-panel.

25. A method of making a dual membered sound wall from two pre-formed half-panels, comprising the steps of:

placing a mold box horizontally on a work table, the mold box being of predetermined dimensions substantially equal to the half-panel dimensions, the box having a closed base, upstanding side and end walls, and an open top;

installing a layer of re-bar in the mold box to extend across the entire width and length of the box, the re-bar layer being spaced between the top and bottom of the box;

installing a plurality of embedment angle iron members at spaced intervals around the periphery of the open top of the box, each angle iron having a first leg extending downwardly adjacent a respective wall of the box and a second leg projecting inwardly and co-planar with the open top of the box;

pouring enough concrete to fill the mold box;

allowing the concrete to set such that the re-bar layer is embedded within and the angle iron members are positioned around the periphery of one, inner face of the half-panel;

repeating the process to form an identical second half-panel;

placing at least two half-panels face to face with their inner faces facing inwards; and securing the half-panels together.

26. The method as claimed in claim 25, wherein a surface liner is placed in the mold box before the installation of the re-bar wherein the liner is the negative surface of the positive textured half-plate surface formed when the concrete is poured into the mold and the half-plate takes the designated textured shape.

27. The method as claimed in claim 25, wherein a stamp apparatus presses a textured profile onto the half-plate so that the half-plate takes the designated textured shape.

28. The method as claimed in claim 25, wherein a plurality of spacer plates are placed between the half-plates that are positioned face to face with their inner faces facing inwards so that a gap is defined between the two half-plates.

29. The method as claimed in claim 28, wherein the step of connecting the two half-panels together is performed by welding the facing pairs of angle irons from the two half-plates so that they are integrally connected with each other and additionally to the spacer plate located between the two plates.

30. A dual membered sound wall apparatus, comprising:

first and second pre-formed half panels of identical shape and dimensions, each half panel having an inner surface, an outer surface, and a peripheral edge, the peripheral edge having opposite sides and opposite ends;

each half panel being of concrete material and an embedded layer of mesh re-bar in the concrete material extending substantially throughout the entire area of the half panels;

a plurality of separate angle irons positioned at spaced intervals along the peripheral edge of each half panel, each angle iron having a first leg extending inwardly and co-planar with the inner surface of the half panel and a second leg extending coplanar with the peripheral edge of the half panel towards the outer surface of the half panel;

the concrete material extending up to and forming the peripheral edge of each half panel;

the half panels being positioned parallel to one another with the inner face of the first half panel facing the inner face of the second half panel and the first leg of each angle iron on the first half panel facing and aligned with the first leg of the respective angle iron on the second half panel, whereby the outer faces of the half panels face outwardly and away from one another and each outer face has a substantially uninterrupted peripheral edge of concrete material; and securing means for securing the aligned first legs of the angle irons together.

31. The apparatus as claimed in claim 30, wherein the second leg of each angle iron terminates short of the outer surface of the respective half panel.

* * * * *